US009618172B1

(12) United States Patent
Means, III

(10) Patent No.: US 9,618,172 B1
(45) Date of Patent: Apr. 11, 2017

(54) TRACK LIGHTING KIT CONFIGURED FOR USE WITH A SINGLE CEILING LIGHT FIXTURE

(71) Applicant: Hudis Means, III, Morrow, GA (US)

(72) Inventor: Hudis Means, III, Morrow, GA (US)

( * ) Notice: Subject to any disclaimer, the term of this patent is extended or adjusted under 35 U.S.C. 154(b) by 343 days.

(21) Appl. No.: 14/231,990

(22) Filed: Apr. 1, 2014

(51) Int. Cl.

| | |
|---|---|
| ***H01R 33/00*** | (2006.01) |
| ***F21S 8/00*** | (2006.01) |
| ***F21S 8/04*** | (2006.01) |
| ***F21S 8/06*** | (2006.01) |
| ***F21V 21/005*** | (2006.01) |
| ***F21V 21/30*** | (2006.01) |

(52) U.S. Cl.
CPC ..... *F21S 8/066* (2013.01); *F21S 8/038* (2013.01); *F21S 8/046* (2013.01); *F21V 21/005* (2013.01); *F21V 21/30* (2013.01)

(58) Field of Classification Search
CPC .. F21S 8/038; F21S 8/046; F21S 8/066; F21S 8/04; F21V 21/005; F21V 21/34; F21V 21/30; F21V 21/35
USPC ..... 362/648
See application file for complete search history.

(56) References Cited

U.S. PATENT DOCUMENTS

| | | | | |
|---|---|---|---|---|
| 4,861,273 A | | 8/1989 | Wenman | |
| D402,964 S | | 12/1998 | Kuchar | |
| 6,095,660 A | * | 8/2000 | Moriyama | F21S 8/026 362/147 |
| 6,135,615 A | * | 10/2000 | Lee | F21V 21/35 362/147 |
| 7,771,085 B2 | | 8/2010 | Kim | |
| 7,887,331 B1 | | 2/2011 | Lin | |
| 2005/0237769 A1 | * | 10/2005 | Hong | H01R 25/147 362/648 |
| 2005/0254262 A1 | * | 11/2005 | Chiu | A47F 11/10 362/648 |
| 2006/0256561 A1 | | 11/2006 | Smith | |
| 2007/0115694 A1 | * | 5/2007 | Mobarak | H01R 25/142 362/648 |
| 2010/0296685 A1 | | 11/2010 | Carle, Jr. | |

* cited by examiner

*Primary Examiner* — Peggy Neils
*Assistant Examiner* — William N Harris
(74) *Attorney, Agent, or Firm* — Kyle A. Fletcher, Esq.

(57) ABSTRACT

The track lighting assembly includes a rail that may be positioned proximate the ceiling light fixture. A socket is coupled to the rail. The socket is selectively operationally coupled to the ceiling light fixture. The rail is retained on the ceiling light fixture. A rail contact is coupled to the rail. The rail contact is operationally coupled to the socket. A light support is operationally coupled to the rail. The light support is selectively movable along the rail. The light support is operationally coupled to the contact. The light support is in communication with the socket. A fixture is operationally coupled to the light support. The fixture is in communication with the contact. A light emitter is operationally coupled to the fixture. The light emitter selectively emits light.

12 Claims, 4 Drawing Sheets

TRACK LIGHTING KIT CONFIGURED FOR USE WITH A SINGLE CEILING LIGHT FIXTURE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of track lighting kits, more specifically, track lighting kits configured for use with a single ceiling light fixture.

SUMMARY OF THE INVENTION

An embodiment of the disclosure meets the needs presented above by generally comprising a rail that may be positioned proximate the ceiling light fixture. A socket is coupled to the rail. The socket is selectively operationally coupled to the ceiling light fixture. The rail is retained on the ceiling light fixture. A rail contact is coupled to the rail. The rail contact is operationally coupled to the socket. A light support is operationally coupled to the rail. The light support is selectively movable along the rail. The light support is communication with the socket. A fixture is operationally coupled to the light support. The fixture is in communication with the contact. A light emitter is operationally coupled to the fixture. The light emitter selectively emits light.

An object of the invention is to provide a device that is track lighting kit configured for use with a single ceiling light fixture.

These together with additional objects, features and advantages of the track lighting kit configured for use with a single ceiling light fixture will be readily apparent to those of ordinary skill in the art upon reading the following detailed description of presently preferred, but nonetheless illustrative, embodiments of the track lighting kit configured for use with a single ceiling light fixture when taken in conjunction with the accompanying drawings.

In this respect, before explaining the current embodiments of the track lighting kit configured for use with a single ceiling light fixture in detail, it is to be understood that the track lighting kit configured for use with a single ceiling light fixture is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of track lighting kit configured for use with a single ceiling light fixture.

It is therefore important that the claims be regarded as including such equivalent construction insofar as they do not depart from the spirit and scope of track lighting kit configured for use with a single ceiling light fixture. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
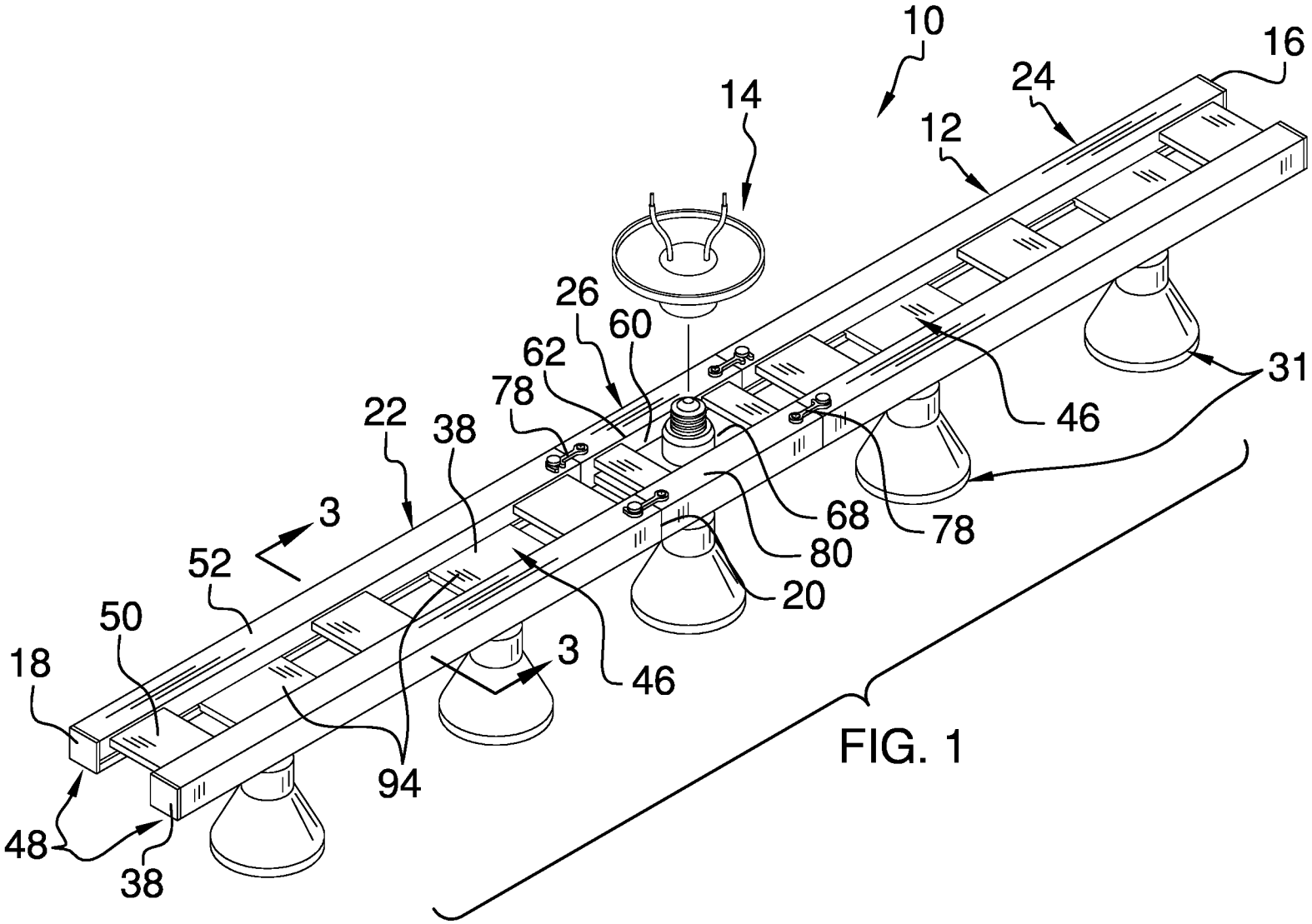
FIG. 1 is a perspective view of a track lighting assembly according to an embodiment of the disclosure.
Figure 2:
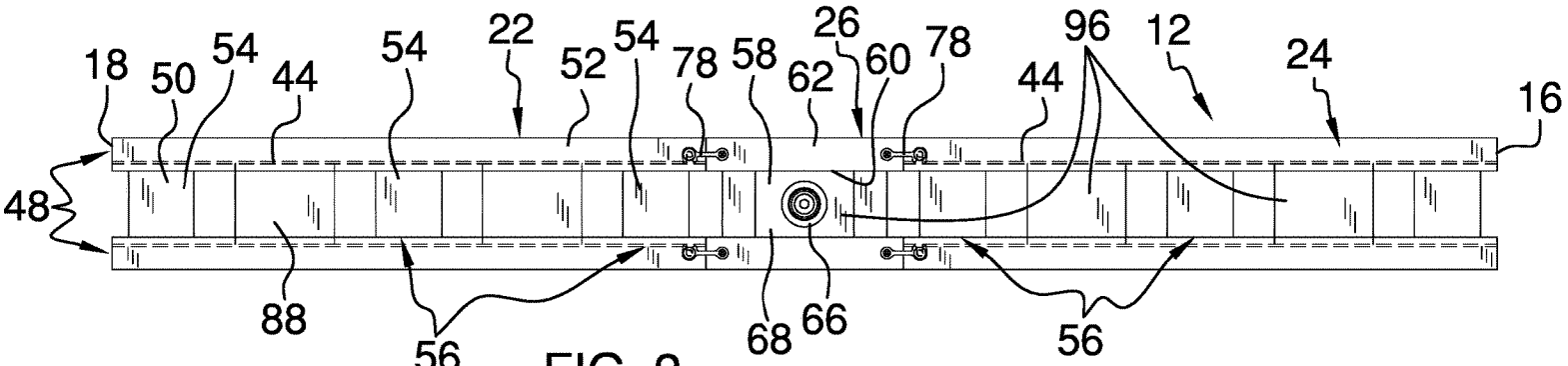
FIG. 2 is a top view of an embodiment of the disclosure.
Figure 3:
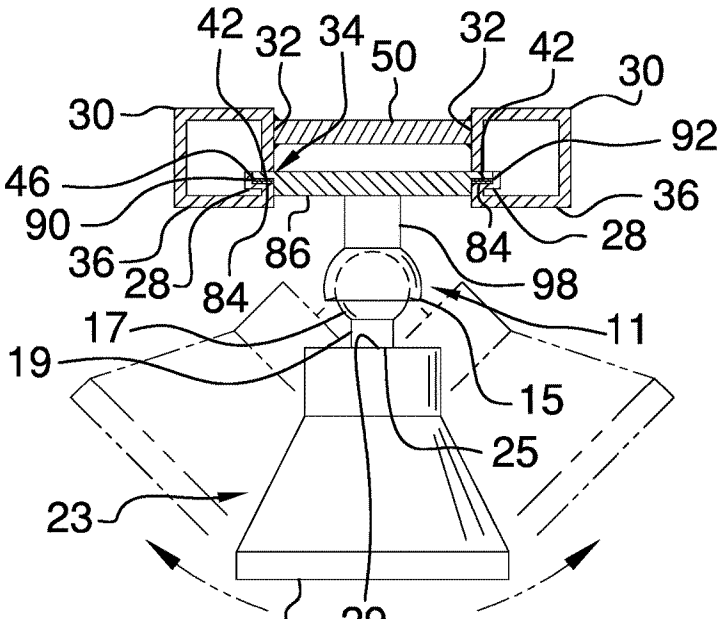
FIG. 3 is a cross sectional view of an embodiment of the disclosure.
Figure 4:
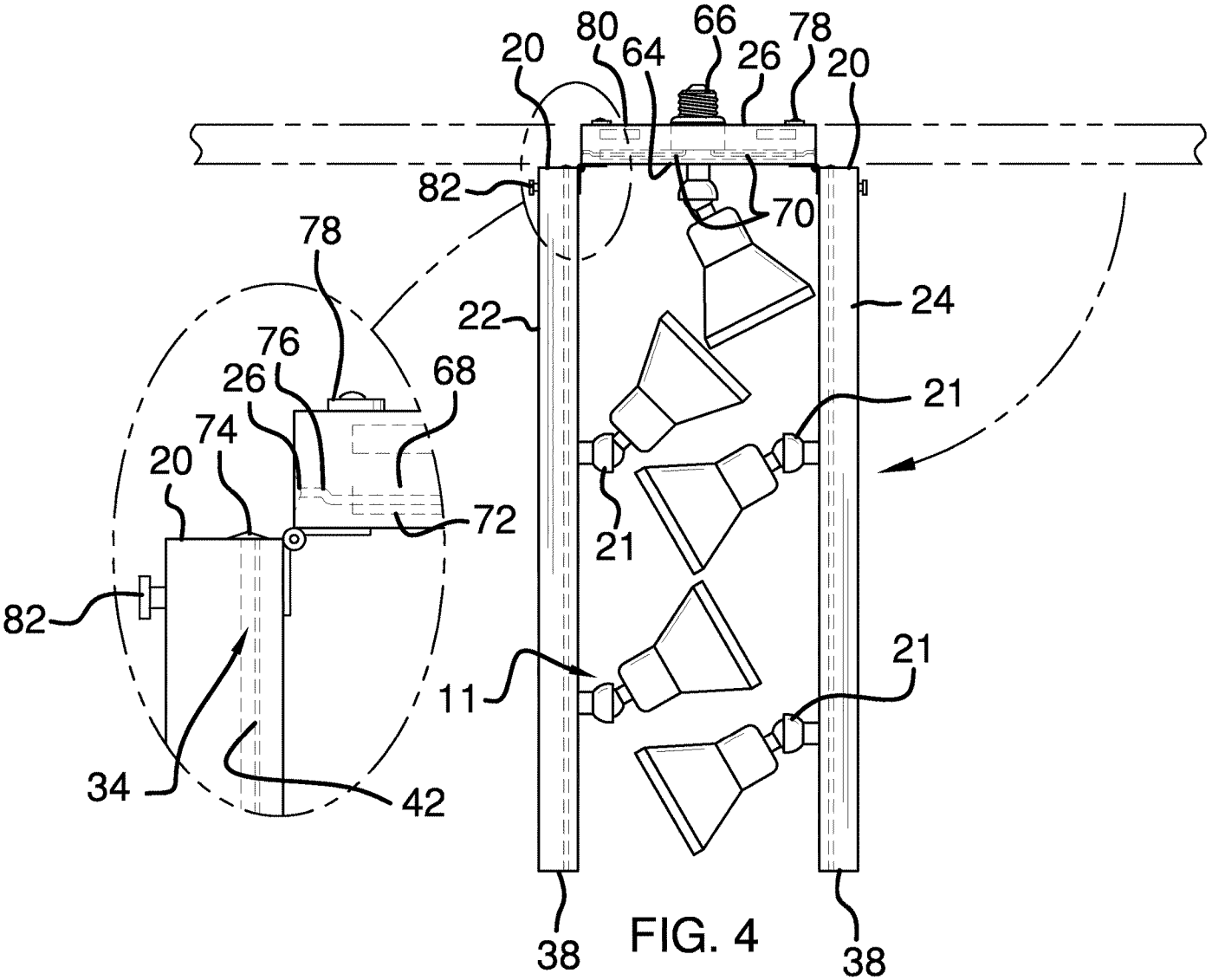
FIG. 4 is a front perspective view of an embodiment of the disclosure.
Figure 5:
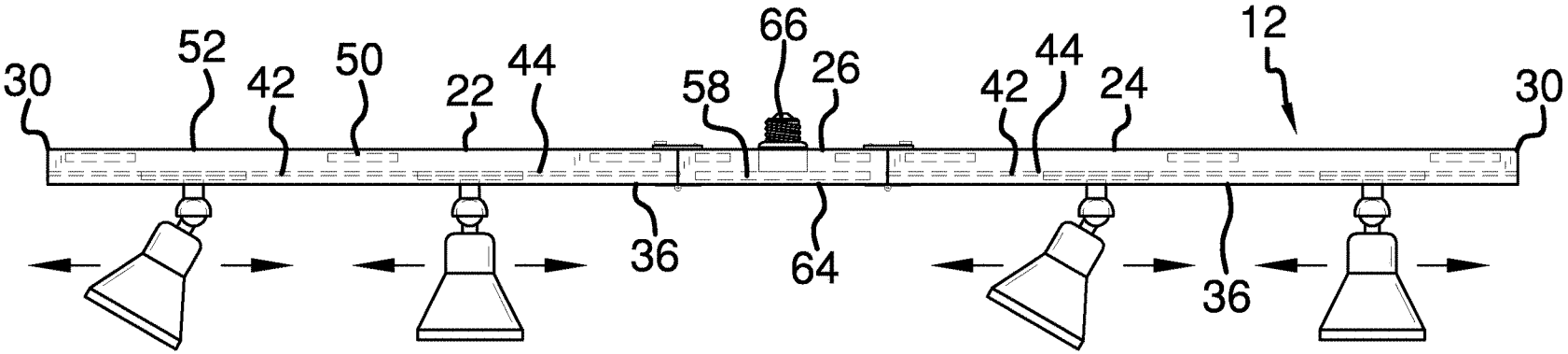
FIG. 5 is a front view of an embodiment of the disclosure.

As best illustrated in FIGS. 1 through 5, the track lighting assembly 10 generally comprises a rail 12 that may be positioned proximate a ceiling light fixture 14. The ceiling light fixture 14 may be of any conventional design. Continuing, the rail 12 has a height that is similar to a width of the rail 12. The rail 12 has a rectangular cross section taken perpendicular to a line extending through a first end 16 and a second end 18 of the rail 12.

A second end 20 of each of a first 22 and a second 24 section of the rail 12 is hingedly coupled to an associated one of opposite ends of a central section 26 of the rail 12. Each of the first 22 and second 24 sections of the rail 12 may have a length between 30 cm and 60 cm. Each of the first 22 and second 24 sections of the rail 12 is positionable in an extended position. Additionally, each of the first 22 and second 24 sections of the rail 12 extends laterally away from the associated one of the opposite ends of the central section 26 of the rail 12. Each of the first 22 and second 24 sections of the rail 12 is positionable in a folded position. Lastly, each of the first 22 and second 24 sections of the rail 12 extends downwardly from the associated one of the opposite ends of the central section 26 of the rail 12.

A contact portion 28 of an outer wall 30 of each of the first 22 and second 24 sections of the rail 12 extends inwardly from a first lateral side 32 of the outer wall 30 of each of first 22 and second 24 sections of the rail 12. Moreover, a contact opening 34 is formed in the first lateral side 32 of the outer wall 30 of each of the first 22 and second 24 sections of the rail 12. The contact opening 34 is positioned proximate a bottom side 36 of the outer wall 30 of each the first 22 and second 24 sections of the rail 12. Additionally, the contact opening 34 extends between a first end 38 and the second end 20 of each of the first 22 and second 24 sections of the rail 12. Finally, the contact opening 34 may have a height between 2 mm and 4 mm.

A rail contact 42 is coupled to the rail 12. The rail contact 42 may be comprised of a rigid and electrically conductive material such as copper or other similar material. Moreover, the rail contact 42 is one of a pair of the rail contacts 44. Each of the pair of rail contacts 44 is coupled to a top side 46 of the contact portion 28 of the outer wall 30 of an associated one of the first 22 and second 24 sections of the rail 12. The pair of rail contacts 44 each is coextensive with the contact portion 28 of the outer wall 30 of the associated one of the first 22 and second 24 sections of the rail 12. Finally, the rail 12 is one of a pair of the rails 48.

A support plate 50 is coupled between the first lateral side 32 of the outer wall 30 of each of the first 22 and second 24 sections of the pair of rails 48. The pair of rails 48 are oriented so the contact opening 34 on each of the first 22 and second 24 sections of the pair of rails 48 faces each other. Moreover, the support plate 50 is positioned proximate a top side 52 of the outer wall 30 of each of the first 22 and second 24 sections of the pair of rails 48. Finally, the support plate 50 may have a length between 2 cm and 3 cm and a width between 3 cm and 4 cm.

The support plate 50 is one of a plurality of the support plates 54. Additionally, the plurality of support plates 54 is evenly spaced apart. Continuing, the plurality of support plates 54 comprises a pair of sets of the plurality of support plates 56. Each of the pair of sets of support plates 56 is distributed between the first 38 and second 40 ends of an associated one of the first 22 and second 24 sections of the pair of rails 48.

A socket support plate 58 is coupled between a first lateral side 60 of an outer wall 62 of the central section 26 of each of the pair of rails 48. The socket support plate 58 is positioned proximate a bottom side 64 of the outer wall 62 of the central section 26 of the pair of rails 48. The socket support plate 58 may have a length between 4 cm and 6 cm. Lastly, the socket support plate 58 may have a width between 3 cm and 4 cm.

A socket 66 is coupled to and extends upwardly from a top side 68 of the socket support plate 58. The socket 66 is selectively electrically coupled to the ceiling light fixture 14. Moreover, the socket 66 retains the pair of rails 48 on the ceiling light fixture 14. Finally, the socket 66 may be a male light socket of any conventional design.

A plurality of socket conductors 70 is electrically coupled to the socket 66. The plurality of socket conductors 70 may each be comprised of a electrically conductive material such as copper or other similar material. Additionally, the plurality of socket conductors 70 is positioned between the top side 68 and a bottom side 72 of the socket support plate 58. Lastly, the plurality of socket conductors 70 extends between the socket 66 and opposite ends of the central section 26 of the pair of rails 48.

The pair of rail contacts 44 on each of the first 22 and second 24 section of the pair of rails 48 each has an conical engaging end 74. Further, the plurality of socket conductors 70 each has a receiving end 76. The conical engaging end 74 of the pair of rail contacts 44 selectively engages the receiving end 76 of an associated one of the plurality of socket conductors 70 when the first 22 and second 24 sections of the pair of rails 48 are positioned in an extended position. Finally, the pair of rail contacts 44 on each of the first 22 and second 24 sections of the pair of rails 48 are selectively electrically coupled to the socket 66.

A plurality of hooks 78 is each movably coupled to a top side 80 of the central section 26 of each of the pair of rails 48. Further, each of the plurality of hooks 78 is positioned proximate an associated one of the opposite ends of the central section 26 of each of the pair of rails 48. A plurality of pins 82 is coupled to the top side 52 of the outer wall 30 of each of the first 22 and second 24 sections of the pair of rails 48. Additionally, each of the plurality of pins 82 is positioned proximate the second ends 40 of each of the first 22 and second 24 sections of the pair of rails 48. Each of the plurality of hooks 78 selectively engages an associated one of the plurality of pins 82 when the first 22 and second 24 sections of the pair of rails 48 are positioned in the extended position. Finally, the plurality of hooks 78 and pins 82 retains the first 22 and second 24 sections of the pair of rails 48 in the extended position.

A pair of light contacts 84 are each coupled to a bottom side 86 of a light support 88. The light support 88 may have a length and a width between 3 cm and 4 cm. Continuing, the pair of light contacts 84 are coextensive with an associated one of a first lateral edge 90 and a second lateral edge 92 of the light support 88. Each of the pair of light contacts 84 may be comprised of a rigid and electrically conductive material such as copper or other similar material.

Each of the first 90 and second 92 lateral edges of the light support 88 is positioned within the contact opening 34 in each of the pair of rails 48. The light support 88 is movably coupled between the pair of rails 48. Additionally, the light support 88 is positionable at a selected point along the length of the pair of rails 48. The pair of light contacts 84 engages an associated one of the pair of rails contacts 44. Moreover, the pair of light contacts 84 is electrically coupled to the associated one of the pair of rail contacts 44.

The light support 88 is one of a plurality of the light supports 94. Additionally, the plurality of light supports 94 comprises a pair of sets of the light supports 96. Each of the pair of sets of the light supports 96 is movably coupled to an associated one of the first 22 and second 24 sections of the pair of rails 48. Finally, each of the plurality of light supports 94 is movable independently of the remaining ones of the plurality of light supports 94.

A top portion 98 of a fixture 11 is coupled to and extends downwardly from the bottom side 86 of the light support 88. A bottom end 15 of the top portion 98 of the fixture 11 has a bowl shape. A top end 17 of a bottom portion 19 of the fixture 11 has a ball shape. The top end 17 of the bottom portion 19 of the fixture 11 is movably coupled to the bottom end 15 of the top portion 98 of the fixture 11. Additionally, the fixture 11 is electrically coupled to the pair of light contacts 84. Lastly, the fixture 11 is one of a plurality of the fixtures 21 each coupled to an associated one of the plurality of light supports 94.

A light emitter 23 is coupled to a bottom end 25 of the bottom portion 19 of the fixture 11. A bottom end 27 of the light emitter 23 has a diameter that is greater than a diameter of a top end 29 of the light emitter 23. The light emitter 23 has a bell shape. Moreover, the light emitter 23 is electrically coupled to the fixture 11 so the light emitter 23 selectively emits light. The light emitter 23 may be an incandescent light bulb of any conventional design. Finally, the light emitter 23 is one of a plurality of the light emitters 31 each coupled to an associated one of the plurality of fixtures 21.

In use, the first 22 and second 24 sections of the pair of rails 48 are positioned in the extended position after the socket 66 is coupled to the ceiling light fixture 14. Continuing, the plurality of light supports 94 is positioned at a selected point on the pair of rails 48. The bottom portion 19 of the plurality of fixtures 21 is additionally positionable at a selected angle with respect to the top portion 98 of the plurality of fixtures 21. The plurality of fixtures 21 is positionable such that the plurality of light emitters 31 emits light in a selected direction.

With respect to the above description, it is to be realized that the optimum dimensional relationship for the various components of the track lighting assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the track lighting assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A track lighting assembly configured for use with a single ceiling light fixture, said assembly comprising:

a rail configured to be positioned proximate the ceiling light fixture;

a socket coupled to said rail, said socket being selectively operationally coupled to the ceiling light fixture wherein said rail is retained on the ceiling light fixture;

a rail contact coupled to said rail, said rail contact being operationally coupled to said socket;

a light support operationally coupled to said rail, wherein said light support is selectively movable along said rail, said light support being operationally coupled to said contact wherein said light support is in communication with said socket;

a fixture operationally coupled to said light support, wherein said fixture is in communication with said contact;

a light emitter operationally coupled to said fixture wherein said light emitter selectively emits light;

wherein said rail has a height equal to a width of said rail;

wherein said rail has a rectangular cross section taken perpendicular to a line extending through a first end and a second end of said rail;

a second end of each of a first and a second section of said rail being hingedly coupled to an associated one of opposite ends of a central section of said rail;

each of said first and second sections of said rail being positionable in an extended position wherein each of said first and second sections of said rail extends laterally away from the associated one of said opposite ends of said central section of said rail;

each of said first and second sections of said rail being positionable in a folded position wherein each of said first and second sections of said rail extends downwardly from the associated one of said opposite ends of said central section of said rail;

a support plate coupled between a first lateral side of an outer wall of each of a first and a second section of a pair of said rails wherein a contact opening on each of said first and second sections of said rail faces each other;

said support plate being positioned proximate a top side of said outer wall of each of said first and second sections of said pair of rails;

said support plate being one of a plurality of said support plates;

said plurality of support plates being evenly spaced apart wherein said plurality of support plates is distributed between a first end and a second end of each of said first and second sections of said pair of rails.

2. The assembly according to claim 1 wherein:

a contact portion of an outer wall of each of a first and a second section of said rail extending inwardly from a first lateral side of said outer wall of each of first and second sections of said rail, wherein a contact opening is formed in said first lateral side of said outer wall of each of said first and second sections of said rail; and said contact opening extending between a first end and a second end of each of said first and second sections of said rail.

3. The assembly according to claim 1 wherein:

said rail contact being one of a pair of said rail contacts;

each of said pair of rail contacts being coupled to a top side of a contact portion of an outer wall of an associated one of a first section and a second section of said rail; and said pair of rail contacts each being coextensive with said contact portion of said outer wall of the associated one of said first and second sections of said rail.

4. The assembly according to claim 1 wherein said rail being one of a pair of said rails.

5. The assembly according to claim 1 wherein:

a socket support plate coupled between a first lateral side of an outer wall of a central section of each of a pair of said rails;

said socket support plate being positioned proximate a bottom side of said outer wall of said central section of said pair of rails;

said socket being coupled to and extending upwardly from a top side of said socket support plate; and a plurality of socket conductors electrically coupled to said socket wherein said plurality of socket conductors extends between said socket and opposite ends of said central section of said pair of rails.

6. The assembly according to claim 1 wherein an engaging end of a pair of rail contacts on each of a first and a second section of a pair of rails engaging a receiving end of an associated one of a plurality of socket conductors when said first and second rails are positioned in an extended position wherein said pair of rail contacts on each of said first and second sections of said pair of rails are electrically coupled to said socket.

7. The assembly according to claim 1 wherein a pair of light contacts each coupled to a bottom side of said light support wherein said pair of light contacts are coextensive with an associated one of a first lateral edge and a second lateral edge of said light support.

8. The assembly according to claim 1 wherein:

each of a first lateral edge and a second lateral edge of said light support being positioned within a contact opening in each of a pair of rails; wherein said light support is movably coupled between said pair of rails; and a pair of light contacts engaging an associated one of a pair of rail contacts wherein said pair of light contacts is electrically coupled to the associated one of said pair of rail contacts.

9. The assembly according to claim 1 wherein:

said fixture being coupled to and extending downwardly from a bottom side of said light support; and said fixture being electrically coupled to a pair of light contacts.

10. The assembly according to claim 1 wherein said light emitter being coupled to a bottom end of said fixture wherein said light emitter is electrically coupled to said fixture.

11. The assembly according to claim 1 wherein:

said light support being one of a plurality of said light supports;

said plurality of light supports comprising a pair of sets of said light supports;

each of said pair of sets of said light supports being movably coupled to an associated one of a first section and a second section of a pair of said rails;

said fixture being one of a plurality of said fixtures each coupled to an associated one of said plurality of light supports; and said light emitter being one of a plurality of light emitters each coupled to and associated one of said plurality of fixtures.

12. A track lighting assembly configured for use with a single ceiling light fixture, said assembly comprising:

a rail configured to be positioned proximate the ceiling light fixture;

a socket coupled to said rail, said socket being selectively operationally coupled to the ceiling light fixture;

wherein said rail is retained on the ceiling light fixture;

a rail contact coupled to said rail, said rail contact being operationally coupled to said socket;

a light support operationally coupled to said rail wherein said light support is selectively movable along said rail, said light support being operationally coupled to said contact wherein said light support is in communication with said socket;

a fixture operationally coupled to said light support wherein said fixture is in communication with said contact;

a light emitter operationally coupled to said fixture wherein said light emitter selectively emits light;

wherein said rail has a height equal to a width of said rail, wherein said rail has a rectangular cross section taken perpendicular to a line extending through a first end and a second end of said rail;

a second end of each of a first and a second section of said rail being hingedly coupled to an associated one of opposite ends of a central section of said rail;

each of said first and second sections of said rail being positionable in an extended position;

wherein each of said first and second sections of said rail extends laterally away from the associated one of said opposite ends of said central section of said rail;

each of said first and second sections of said rail being positionable in a folded position wherein each of said first and second sections of said rail extends downwardly from the associated one of said opposite ends of said central section of said rail;

a contact portion of an outer wall of each of said first and second sections of said rail extending inwardly from a first lateral side of said outer wall of each of first and second sections of said rail;

wherein a contact opening is formed in said first lateral side of said outer wall of each of said first and second sections of said rail;

said contact opening extending between a first end and a second end of each of said first and second sections of said rail;

wherein said rail contact being one of a pair of said rail contacts;

each of said pair of rail contacts being coupled to a top side of a contact portion of an outer wall of an associated one of a first section and a second section of said rail;

said pair of rail contacts each being coextensive with said contact portion of said outer wall of the associated one of said first and second sections of said rail;

said rail being one of a pair of said rails;

a support plate coupled between a first lateral side of said outer wall of each of said first and second sections of said pair of rails;

wherein the contact opening on each of said first and second sections of said rail faces each other;

said support plate being positioned proximate a top side of said outer wall of each of said first and second sections of said pair of rails;

said support plate being one of a plurality of said support plates;

said plurality of support plates being evenly spaced apart;

wherein said plurality of support plates is distributed between a first end and a second end of each of said first and second sections of said pair of rails;

wherein a socket support plate coupled between a first lateral side of an outer wall of a central section of each of a pair of said rails;

said socket support plate being positioned proximate a bottom side of said outer wall of said central section of said pair of rails;

said socket being coupled to and extending upwardly from a top side of said socket support plate;

a plurality of socket conductors electrically coupled to said socket;

wherein said plurality of socket conductors extends between said socket and opposite ends of said central section of said pair of rails;

an engaging end of a pair of rail contacts on each of a first and a second section of said pair of rails engaging a receiving end of an associated one of said plurality of socket conductors when said first and second rails are positioned in an extended position;

wherein said pair of rail contacts on each of said first and second sections of said pair of rails are electrically coupled to said socket;

wherein a pair of light contacts each coupled to a bottom side of said light support;

wherein said pair of light contacts are coextensive with an associated one of a first lateral edge and a second lateral edge of said light support;

each of a first lateral edge and a second lateral edge of said light support being positioned within a contact opening in each of a pair of rails;

wherein said light support is movably coupled between said pair of rails;

said pair of light contacts engaging an associated one of a pair of rails contacts;

wherein said pair of light contacts is electrically coupled to the associated one of said pair of rail contacts;

said light emitter being coupled to a bottom end of said fixture wherein said light emitter is electrically coupled to said fixture;

said light support being one of a plurality of said light supports; said plurality of light supports comprising a pair of sets of said light supports;

each of said pair of sets of said light supports being movably coupled to an associated one of a first section and a second section of said pair of rails;

said fixture being coupled to and extending downwardly from a bottom side of said light support;

said fixture being electrically coupled to a pair of light contacts;

said fixture being one of a plurality of said fixtures each coupled to an associated one of said plurality of light supports;

said light emitter being one of a plurality of light emitters each coupled to an associated one of said plurality of fixtures.

* * * * *